US007481334B2

(12) United States Patent
Arghyris et al.

(10) Patent No.: US 7,481,334 B2
(45) Date of Patent: Jan. 27, 2009

(54) DEVICE FOR CONDITIONING AND DISTRIBUTING SEVERAL FLUIDS, COMPRISING AT LEAST TWO PUMPS

(75) Inventors: Laurent Arghyris, Boege (FR); Patrice Puviland, La Roche sur Foron (FR); Jean-Philippe Taberlet, Villard (FR)

(73) Assignee: LABLABO, Annemasse ( * ) Notice: Subject to any disclaimer, the term of this patent is extended or adjusted under 35 U.S.C. 154(b) by 422 days.

(21) Appl. No.: 10/501,730

(22) PCT Filed: Feb. 12, 2003

(86) PCT No.: PCT/FR03/00453

§ 371 (c)(1),
(2), (4) Date: Jul. 16, 2004

(87) PCT Pub. No.: WO03/068410

PCT Pub. Date: Aug. 21, 2003

(65) Prior Publication Data

US 2005/0042122 A1 Feb. 24, 2005

(30) Foreign Application Priority Data

Feb. 13, 2002 (FR) ..... 02 01773

(51) Int. Cl.
*B67D 5/52* (2006.01)
*B65D 35/18* (2006.01)
*B65D 88/54* (2006.01)

(52) U.S. Cl. ..... 222/137; 222/94; 222/135; 222/105; 222/321.7

(58) Field of Classification Search ..... 222/92–107, 222/210–215, 436, 464.1–464.7, 541.6, 541.9, 222/564, 320–321.9, 135, 136, 137, 139
See application file for complete search history.

(56) References Cited

U.S. PATENT DOCUMENTS

| | | | | | |
|---|---|---|---|---|---|
| 3,239,105 | A | * | 3/1966 | Woodson | 222/94 |
| 3,730,437 | A | * | 5/1973 | Rousselot | 239/306 |
| 4,673,107 | A | * | 6/1987 | Obrist | 222/94 |
| 5,752,627 | A | * | 5/1998 | Vandromme et al. | 222/137 |
| 5,823,394 | A | * | 10/1998 | Davis et al. | 222/137 |
| 5,918,771 | A | | 7/1999 | van der Heijden | |
| 5,954,234 | A | * | 9/1999 | Connan et al. | 222/94 |
| 6,341,717 | B2 | | 1/2002 | Auer | |

* cited by examiner

*Primary Examiner*—Kevin P Shaver
*Assistant Examiner*—Melvin A Cartagena
(74) *Attorney, Agent, or Firm*—Crowell & Moring

(57) ABSTRACT

The conditioning and distribution of fluid products is described. A conditioning and distribution device comprises at least two extraction pumps having parallel axes and at least two reservoirs containing the products to be distributed, or the first pump is mounted in such a way that it is axially moveable in the chamber of the second pump, whereupon the second pump is operated by the movement of the first pump. The device is adapted to distribute several, separate fluids or a mixture thereof.

19 Claims, 3 Drawing Sheets

Figure 2:
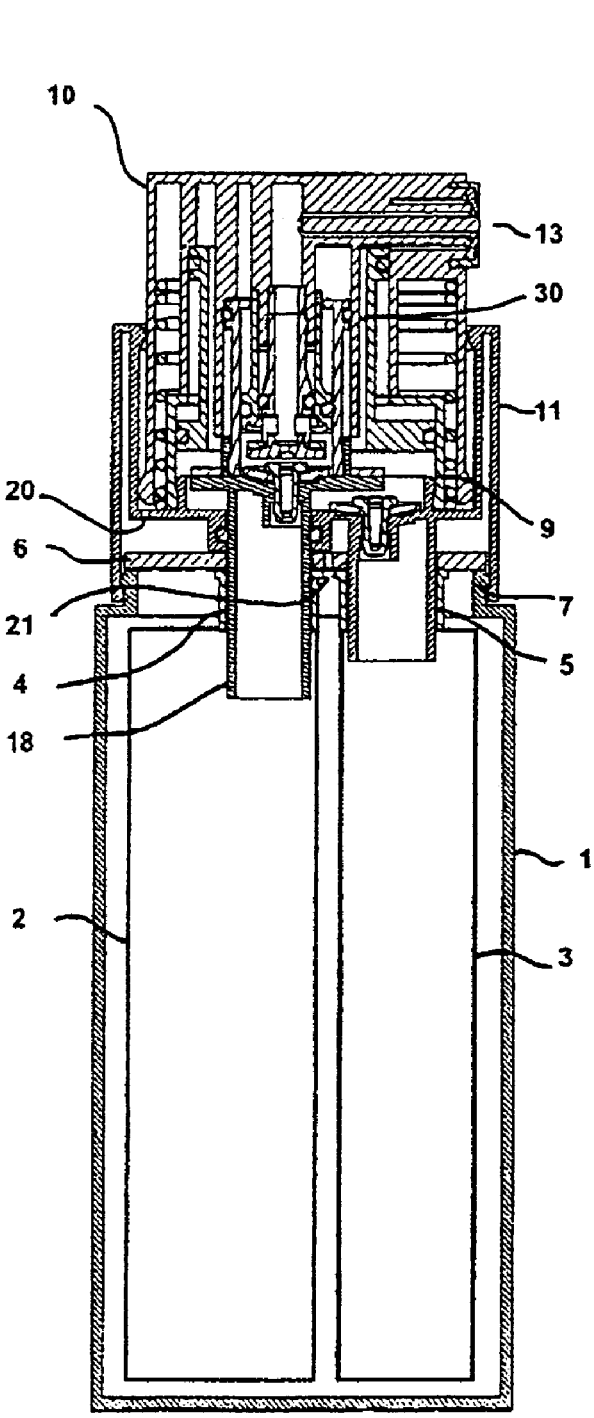

DEVICE FOR CONDITIONING AND DISTRIBUTING SEVERAL FLUIDS, COMPRISING AT LEAST TWO PUMPS

The present invention relates to a novel device for packaging and dispensing fluid products, and more particularly a device for packaging and dispensing fluid, liquid or pasty products, of the type comprising at least two pumps and two containers, for example two flexible bags placed in the same rigid container for storing at least two fluid products, protected from the air, and for dispensing them simultaneously.

Various types of multi-compartment dispensers are well known. Such dispensers make it possible to store two or more products separately, to prevent them reacting with one another for example, so that they are not mixed until they are used. Thus, application WO 99/64319 describes a simple device for dispensing two fluids simultaneously by means of a double pump, more particularly for toothpastes or gels. This device has an upper part mounted telescopically on a lower part, forming a pump with two pistons that move in parallel in two cylinders that are integral with the lower part. Each time the upper part forming a push-button is pressed, variable amounts of products are expelled. Such a device is therefore not suitable when it is necessary to dispense predetermined, constant amounts of products.

Application WO 95/30490 describes a dispensing device with two chambers, for spraying a relatively viscous product by means of a compressed gas. The system, which is of the slide type, works by virtue of a rod bearing two pistons that move simultaneously and in parallel, one in a first chamber containing the viscous product coming from the container, and the other in a second chamber containing the spraying gas, generally air from the external environment. According to a variant of the same device, the gas may be replaced by a second component, and in this case the second chamber communicates with the container that contains the two products, one of which is in a flexible bag. U.S. Pat. No. 5,918,771 describes an aerosol spray device, which may comprise two containers each communicating with a pump, the two pumps being concentric and actuated simultaneously by the same push-button.

Devices of the pocket flask type for packaging and dispensing fluids are well known, and generally comprise a container with a rigid shell in which is placed a flexible bag that contracts as the product is extracted from it. The product may be expelled from the bag using an airless pump, in which case a vent is provided, generally in the base or neck of the flask, to allow external air to enter the space between the flask and the bag each time the pump is actuated, thus allowing the bag to contract while maintaining sufficient pressure on its walls. Because they have a pump, devices of this type make it possible to dispense substantially constant doses of product.

Patent FR 2 723 356 describes an example of a device using this method which comprises a flexible plastic bag placed in a rigid container whose neck has an air inlet. Patent FR 2 804 666 describes another device using this method, designed for the selective dispensing of one or two products, separately or as a mixture, according to which a first product is introduced into the bag whereas the second, together with the propellant gas, are in the rigid container, around the bag, the whole being supplemented with a selective valve. However, this system is relatively complex and requires a special valve.

One problem with these pocket flask devices is to ensure satisfactory sealing of the bag so as to preserve the integrity of the product contained therein. Specifically, the products contained in the bags are often sensitive to oxidation caused by oxygen in the air and can deteriorate if air enters the bag.

Sealing defects are often found at the junction between the bag and the pump. They can also result from a degree of porosity of the materials used to make the bag or tears in the folds formed by the wall of the bag as it contracts, that can let air in which degrades the product contained in the bag.

These problems are exacerbated when it is desired to use two or more bags within the same rigid container to dispense, simultaneously or separately, two or more complementary products. Another problem with devices comprising two bags and two pumps lies in their bulk.

The subject of the present invention is precisely a device for packaging and dispensing fluid, liquid or pasty products, of the type comprising at least two extraction pumps with parallel axes and at least two containers containing the products to be dispensed, which can deliver predetermined, constant doses of products and which take up as little space as possible.

The subject of the invention is also a pocket flask device comprising at least two sealed flexible bags placed in the same single rigid container, connected to at least two pumps, for efficient dispensing of at least two products simultaneously or sequentially, separately or as a mixture.

The subject of the invention is also a device for packaging and dispensing several fluid products each contained in a separate bag, making the bags very easy to fill without the need for complex or specially designed equipment.

The subject of the invention is also a device for packaging and dispensing several fluid products, of the type comprising at least two sealed flexible bags placed in the same single rigid container, ensuring perfect packaging of the products by means of excellent sealing of the bag.

Finally, the subject of the invention is a device of the type stated above, which can be manufactured profitably.

The device for packaging and dispensing fluid products according to the present invention is of the type comprising at least two pumps with parallel axes and at least two containers, each container communicating with a pump, and it is noteworthy in that the first pump is mounted so that it can move axially in the chamber of the second pump, such that the movement of the first pump operates the second pump.

According to a preferred embodiment, the device of the invention comprises a single push-button acting on the piston of the first pump and it comprises means such that the movement of the push-button displaces the body of the first pump and the piston of the second pump in the chamber of the second pump. According to one embodiment, the push-button is designed such that this displacement occurs when the piston of the first pump is at the end of its travel. Thus, the pistons of the pumps are not mounted on the same rod and may move independently along identical or different paths.

As stated above, the two pumps are actuated by the same push-button and move along parallel axes, and preferably the two pumps are coaxial.

Each pump of the device of the invention comprises a dip tube communicating with independent containers, preferably consisting of sealed flexible bags placed in the same single rigid container and comprising means cooperating with at least one ring for fastening to the rigid container and with the pumps.

The device according to the present invention comprises means for coordinating the movement of the two pumps. In one embodiment, these means expel the products contained in the containers or the bags sequentially, and they consist of stops cooperating with shoulders formed on the push-button, on the one hand, and on parts that are integral with the pumps on the other hand, or vice versa, such that, as the push-button moves, a shoulder bears against a stop, thus driving the corresponding part. Therefore, by judiciously placing the stops and the shoulders, it can be devised such that movement of the push-button, from the rest position, causes, successively, the piston rod of the first pump to move and the upper valve to open, then the piston of the first pump to be pushed down in its chamber, expelling the product contained in said chamber, the upper valve of the second pump to open, and lastly the first pump forming a piston to move in the chamber of the second pump, expelling the product contained in this second chamber.

In this embodiment, the products contained in each pump are expelled one immediately after the other with the same movement of the push-button.

According to a preferred embodiment, the device of the invention comprises at least two bags combined with a single ring for fastening to the container and to the pumps, the ring being fastened to the bags by any known fastening means such as welding, adhesive bonding, snap-fastening or mechanical crimping. The single ring used in the invention is advantageously designed to allow fastening of the bags by snapping their necks onto the ring, making the elements of the device easier to manufacture and assemble.

Figure 4:
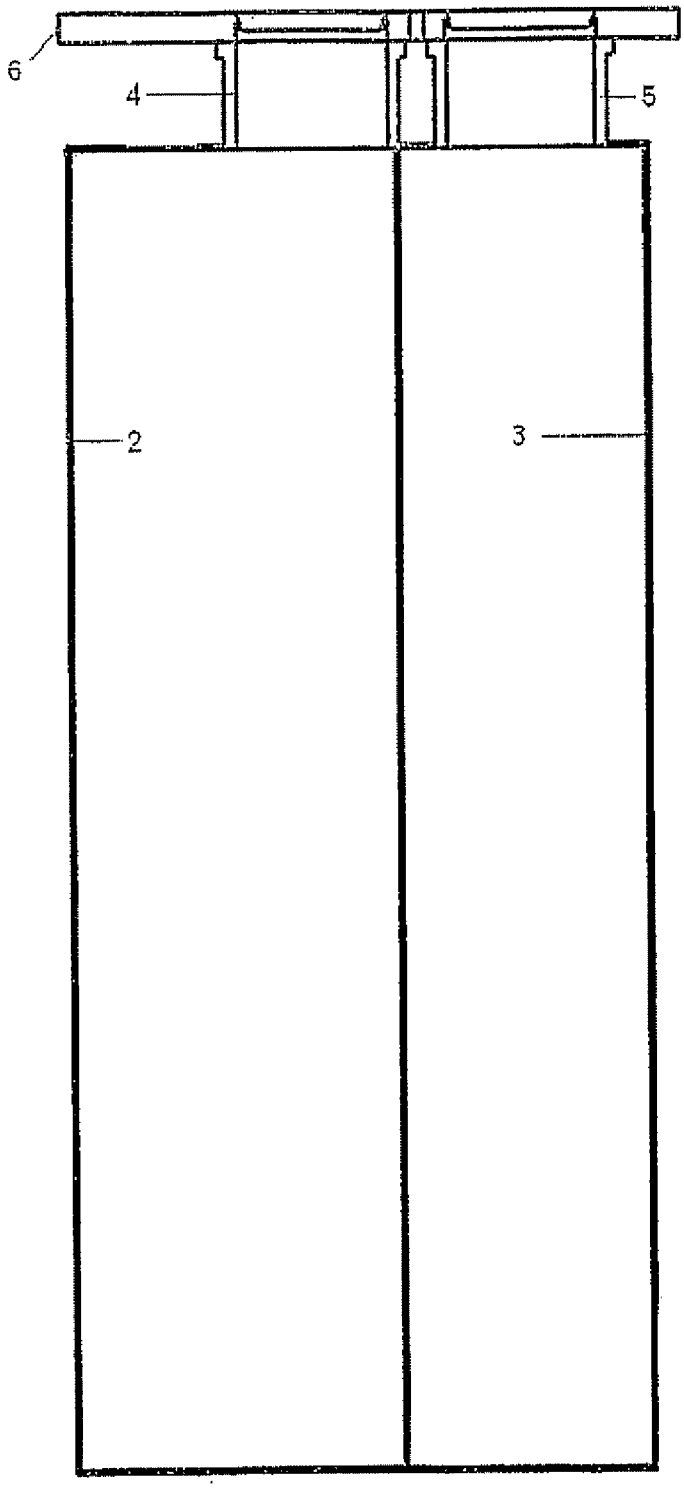

According to an advantageous embodiment, the two bags are combined with a single ring for fastening to the container and to the pumps, and they may be formed as a single piece, in the form of a double bag comprising two compartments separated by a partition (FIG. 4). This double-bag embodiment has the advantage that it stiffens the structure of the bag by means of the separating partition, which simplifies the replacement of the products contained in the bags. The bags may be fastened by any known means, for example by snapping their necks onto the ring.

According to a variant in accordance with the invention, the device comprises two bags, one inside the other, the neck of the larger bag surrounding that of the smaller one, a sufficient space being left between the two necks for filling with and expelling the product.

Naturally, the two bags may be made from different materials, depending on the conditions of use or nature of the products they contain. For example, it may be advantageous to select for each bag a material suitable for the type of products used, in particular when the physico-chemical properties of these products necessitate the use of special materials.

The device according to the present invention has the advantage of being much more compact than a system with two pumps each mounted on a bag or a container and operating in parallel, actuated by the same push-button or by separate push-buttons. The device of the invention is so compact because the pumps fit one inside the other and are complementary.

The plastics used to produce the bags may be chosen for example from among a polyethylene, a polypropylene, a polyamide, an ethylene/vinyl alcohol (EVOH) copolymer, etc. They may consist of single-layer materials or multilayer complexes including a metal layer, for example a layer of aluminum forming a barrier that reinforces sealing, combined with one or more layers of plastic. The bag may be produced using these materials by methods such as injection-blow molding or extrusion-blow molding in a suitable mold. The bag may also be produced by welding a plastic or metal film or a multilayer metal/plastic complex to a support forming the neck of the bag.

The material used for the ring may be a plastic of the same nature as that used for the bag, but treated so as to make it sufficiently rigid, for example by using a greater thickness of material. Thus, polyethylene or polypropylene rings may be used and, as stated above, the ring and the bags may be produced as a single piece, by injection-blow molding or any other suitable method. The rigid container may be produced from plastic or any other suitable rigid material. For example, rigid containers may be made from polyethylene, polyethylene terephthalate (PET), glass or metal, such as aluminum.

The openings made in the ring are preferably arranged symmetrically about the center of the ring, but they may also be nonsymmetrical depending on the shape of the cylinder and the desired effects.

The cylinder formed by the bag or bags may have any shape. For example, it is possible for it not to be a body of revolution, with a section that is not circular, but it is preferably a right cylinder with a semicircular section comprising at least one flat lateral surface serving as the junction between the bags in the same container. Other shapes may easily be made, for example a substantially elliptical shape, or any continuous or polygonal shape, or alternatively a noncylindrical shape, depending on the esthetic effect desired or made necessary by the shape of the rigid container.

According to the Invention, two or more identical bags may be associated, but it is also possible to combine bags of different volumes, the metering chamber of each pump then being preferably adapted to the volume of the corresponding bag. This is particularly advantageous in the case of the dispensing of complementary fluid products that must be mixed in certain quantities. Thus, a device with a rigid container and two flexible bags, each communicating with a pump, according to the invention may be adapted to the ratio of mixing of the two products contained in the bags, and if this ratio must be 2/1 for example, the volume of the second bag can be made to be half that of the first, and likewise for the volume of the metering chamber of the second pump with respect to the first. Thus, each time the single push-button is pressed, two volumes of the first product will be expelled for just one of the second, and the two bags will empty in parallel.

One of the advantages of the device of the invention in which each pump is associated with a separate bag is that it allows all combinations in terms of pump metering and filling of the bags inside the rigid container. In particular, the length of the path traveled by the piston of each pump may be adjusted so as to adjust the ratio of the pump volumes.

In the case of a pocket flask device, in order for the bags to be able to contract inside the rigid container, an external air intake is provided in the form of a vent or an air suction circuit.

In its simplest form, the vent is provided in the wall, for example in the base of the rigid container, and it is preferably equipped with a valve and/or a filter. The air circuit, allowing external air to enter the volume between the wall of the rigid container and the bags, is preferably designed to remain closed while the fluid is stored in each bag and to open only each time the pumps are actuated so as to allow only a volume of air equivalent to the volume of fluid expelled from each bag to enter. When the pumps cease to be actuated, the air circuit is automatically closed, thus ensuring optimum preservation of the products contained in the bags by limiting evaporation through the wall of the bags.

According to a preferred embodiment, the air circuit consists of a passage made in the rim of the pump fastening ring, communicating with the space between the pumps and the push-button, and comprising means, for example valves, for closing it off when the pump is not actuated. Thus, in the rest position, the air circuit can be closed off by the seal created between the pumps and the fastening ring.

The fluid products contained in the bags may be expelled practically simultaneously, i.e. during the same travel of the push-button. Simultaneous, controlled expulsion of the fluid products is advantageous in the case of products that have to be mixed at the time of use in certain proportions. Having a single push-button acting on two or more pumps facilitates this simultaneous expulsion, and the choice of pumps having suitable metering chambers ensures that the mixture is composed in the right proportions. Thus, the metering chambers of the pumps may be proportional to the volume of the bags.

Furthermore, the device of the invention may comprise juxtaposed or concentric product outlet nozzles, to ensure thorough mixing of the products from each bag. According to a variant, the pump outlet ducts may be joined to emerge in a common outlet nozzle. The device of the invention may more particularly comprise an outlet nozzle comprising two concentric annular orifices covered by the same elastic film that can deform to allow the fluids coming from the pumps to exit and press back down on the orifices when the pressure falls again.

The device according to the present invention has the advantage of being easy to fill without it being necessary to use complex equipment. According to the present invention, it can be filled using standard equipment, simply under gravity, thus ensuring very regular filling. Furthermore, the few restrictions on the shape of the bag means it can be easily adapted to rigid containers of various shapes.

Various wording and illustrations may be affixed to the bags or to the rigid container, for example by printing or screen-printing, depending on the envisioned use.

As it is used and the products contained in it are extracted, each bag contracts steadily, limiting the risks of splitting or tearing.

The rate of release of the product, i.e. the ratio between the volume of product introduced into the bag during filling and the volume extracted during use, is excellent, and may be greater than 90%.

The device for packaging and dispensing fluid products according to the invention is especially suitable for packaging and dispensing complementary products that are likely to react with one another and that must be stored separately and must not be mixed until they are used.

One area of application is cosmetic or dermatological compositions, such as creams and gels, which may comprise components having very different properties, for example aqueous phases and oily phases that are not very stable and where it may thus be expedient to mix at the time of use two components which have to be stored separately to prevent them from reacting with one another. Another area of application in which the invention may thus advantageously be used is, for example, two-component adhesives, where one component accelerates the curing of the other.

Figure 1:
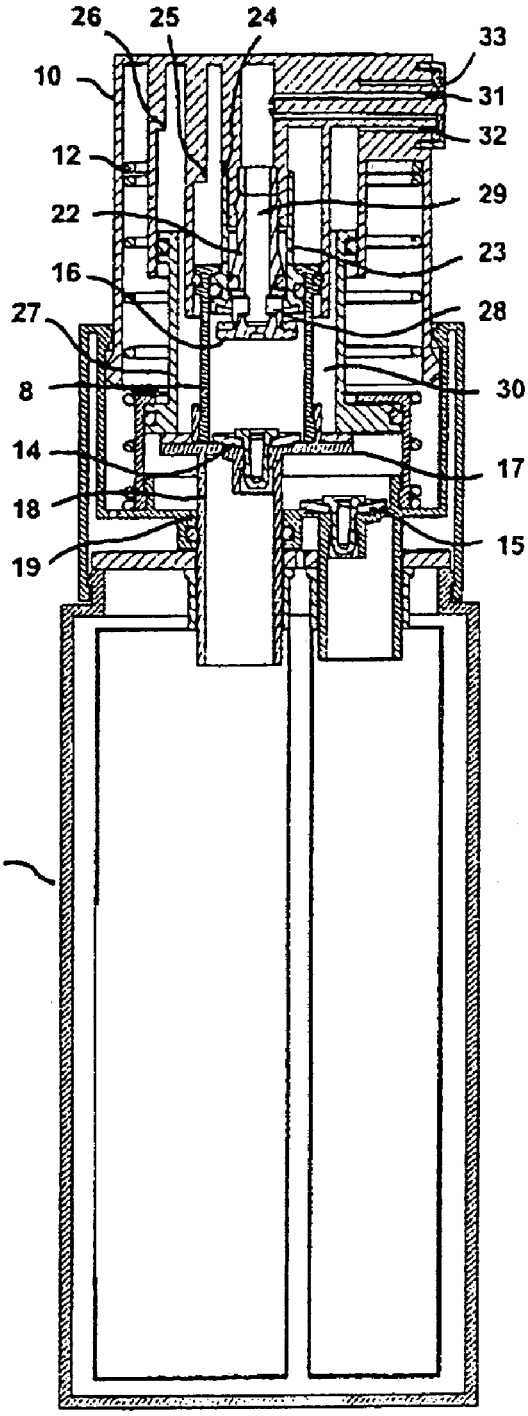

A nonlimiting exemplary embodiment of a pocket flask device according to the present invention for packaging and dispensing several fluids is described in more detail below, with reference to the appended drawings, which show:

FIG. 1: a sectional view of a device according to the present invention, with two pumps and two flexible bags, in which the push-button is raised, almost in its rest position.

FIG. 2: a sectional view of the device according to FIG. 1, with the push-button pushed down.

Figures 3A, 3B, 3C:
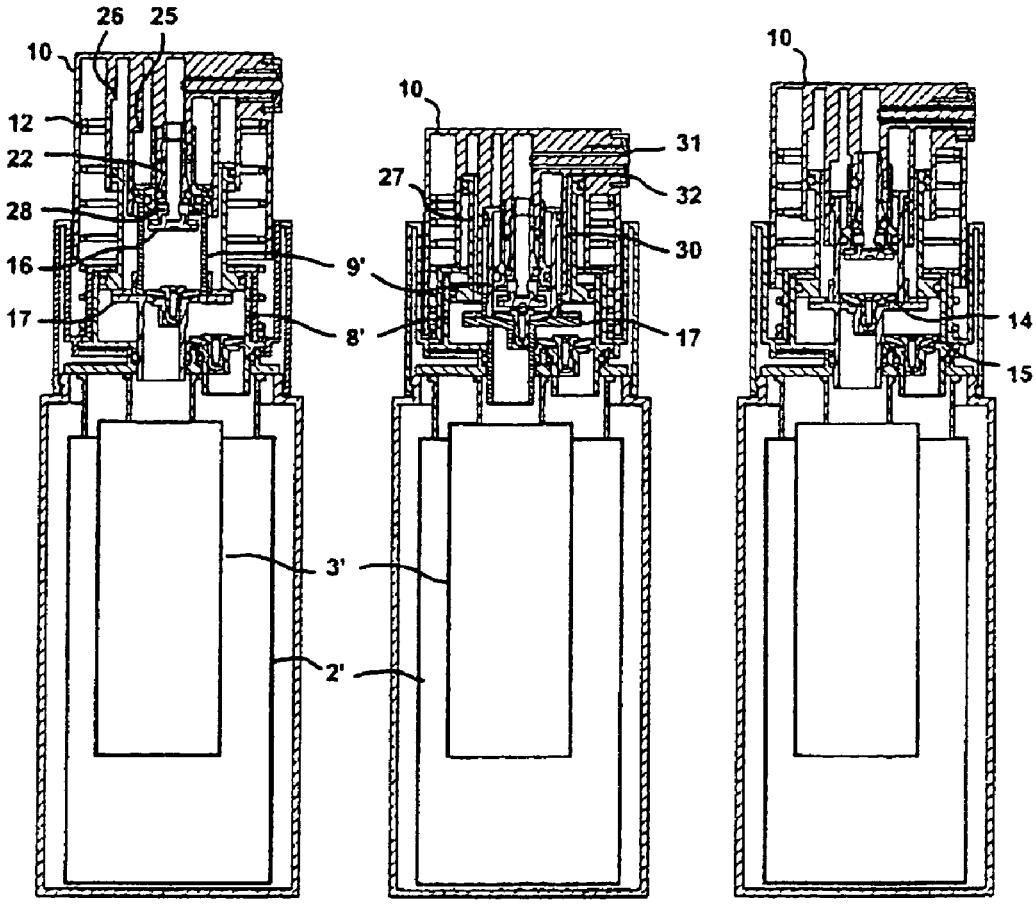

FIG. 3A-3C: a sectional view of a variant of the device of the invention, in which the pumps and the bags are coaxial, a small bag having been placed inside the large bag.

FIG. 4: a sectional view of another variant of the device, in which the two bags are formed a single piece, in the form of a double bag comprising two compartments separated by a partition.

The device shown in FIG. 1 is in a position close to the rest position, in which the push-button is almost totally raised, near the beginning of its travel, whereas it is in the lowered position in FIG. 2.

As shown in FIG. 1, the device of the invention comprises a rigid flask (1) in which are placed two flexible bags (2) and (3). The bags (2) and (3) are fastened by their necks (4) and (5), respectively, to a ring (6) which is itself fastened to the neck (7) of the flask (1). The ring comprises two openings allowing the two pumps (8) and (9) to be fastened in communication with the bags (2) and (3), respectively.

The device is supplemented by a push-button (10) that can slide on the body (11) of the pump (9) when it is actuated by pressing in opposition to the resistance of the spring (12). The push-button also comprises an orifice (13) for the product expelled from the bags (2) and (3) to exit when the pumps are actuated as described below.

Each of the pumps (8) and (9) comprises a lower shut-off valve (14) and (15), respectively. The pump (8) comprises a piston (16) in its upper part, while the base (17) of the pump (8) serves as a piston for the pump (9). To this end, the pump (8) is mounted so as to slide via its dip tube (18), which can slide in the opening (19) made in the base of the pump body (9).

In a conventional manner, the valves (14) and (15) are in the closed position when pressure is exerted on the push-button (10) in opposition to the spring (12), and in the open position when the push-button is released. Conversely, pressing on the push-button (10) causes the pistons (16) and (17) to open, these pistons closing when the push-button rises up under the action of the spring (12).

An air intake is provided by the orifices (20) and (21) formed in the cylinder of the pump (9) and in the ring (6), respectively, allowing external air to enter the space between the inner wall of the flask (1) and the bags (2) and (3) when the push-button (10) is actuated.

The rod (22) of the piston (16) is integral with the push-button (10) and can slide in the cylinder (23), which can itself move in the chamber of the pump (8) but whose upward travel is limited by a stop (24).

Another stop (25) on an internal slideway of the push-button (10) bears against the top of the pump (8) so as to push it when the push-button has been moved a certain distance, corresponding substantially to the travel of the piston (16). Lastly, a third stop (26) cooperates with the upper edge of the cylinder (27).

The device of the invention operates as follows.

When the user presses on the push-button (10), this causes a downward movement in opposition to the action of the spring (12) that bears on the base of the body of the pump (9). At the start of movement, the push-button is in the position shown in FIG. 1. The lower valve (14) of the pump (8) is closed, as is the valve (15) of the pump (9). On the contrary, since the push-button (10) is integral with the rod (22) of the piston (16), the latter opens, and its downward movement expels the product contained in the chamber of the pump (8) via the aperture (28) between the seat and the head of the piston (16), and via the duct (29) as far as the outlet nozzle (13).

As the push-button continues to move, the piston (16) of the pump (8) arrives at the end of its travel, and then the pump body plus piston assembly moves, freeing the piston (17) from its seat and expelling the product contained in the chamber of the pump (9) via the duct (30) as far as the periphery of the nozzle (13). At the end of travel, the device is in the position shown in FIG. 2.

Thus, by pressing progressively on the push-button, the user causes the following to happen in succession: movement of the push-button and piston rod, causing the aperture (28) communicating with the duct (29) to open; then movement of the piston and cylinder assembly in the body of the pump (8) as soon as the stop (24) comes into contact with the edge of the cylinder (23); and lastly, movement of the pump (8) itself in the chamber of the pump (9).

Conversely, when the user releases the push-button (10), the latter rises up under the action of the spring (12), causing two valves (14) and (15) to open and, simultaneously, causing the piston (17) to close against the base of the cylinder (27) and the piston (16) to close against the cylinder (23). This movement causes the product contained in the bag (2) to be sucked up into the chamber of the pump (8) and the product contained in the bag (3) to be sucked up into the chamber of the pump (9).

At the same time, external air enters, via the orifices (20) and (21), the space between the inner wall of the flask (1) and the flexible bags (2) and (3), allowing said bags to contract.

The outlet nozzle (13) consists of two concentric annular orifices. The first orifice (31) communicates with the duct (26) coming from the pump (8) while the external annular orifice (32) communicates with the duct (30) coming from the pump (9). The two orifices (31) and (32) are covered by the same annular film (33), which has a hole in its center and is made of a material that is sufficiently flexible and elastic so as to deform under the pressure of the fluids exiting the pumps and so as to press back down on the orifices when the pressure falls again.

FIG. 3A shows a variant of the device of the invention in which the two bags (2') and (3') are placed one inside the other and communicate with the pumps (8') and (9'), respectively, which are coaxial.

Three successive positions of the pumps are shown in FIGS. 3A, 3B and 3C, respectively, as a function of the movement of the push-button.

FIG. 3A shows the device of the invention with the push-button at the beginning of its travel from the rest position. In this position, the user has begun to press on the push-button (10), in opposition to the action of the spring (12), causing a movement of a few millimeters that drives the rod (22) of the piston (16) of the pump (9') and causes the aperture (28) to open, allowing the product contained in the chamber of this pump to be expelled. In this position, the base of the pump (9') which forms the piston (17) of the pump (8') has not yet moved and the chamber of the pump (8') is therefore closed.

As the push-button continues to move, the piston (16) is displaced within the chamber of the pump (9'), expelling the product via the duct (29) as far as the annular outlet nozzle (31). Then, at the end of travel of the piston (16), the stops (25) and (26) on a slideway integral with the push-button (10) bear successively against the top of the pump (9') and of the cylinder (27) respectively, pushing the piston (17) and then the cylinder (27) down into the pump (8'). As soon as the piston (17) moves, the product contained in the pump (8') can escape via the duct (30) and it is expelled as far as the annular outlet nozzle (32).

The movement thus continues as far as the position shown in FIG. 3B, in which the displacement of the pistons (16) and (17) has freed the opening for discharging the products contained in the chambers, while the lower valves (14) and (15) of the pumps (9') and (8'), respectively, are closed.

When the pressure on the push-button (10) is released, the latter rises up under the action of the spring (12), causing the pistons and pumps to move in the opposite direction. The product outlet ducts (30) and (29) close successively, causing the lower valves (15) and (14) to open and the products contained in the bags (2') and (3'), respectively, to be sucked up. FIG. 3C shows the device with the push-button in the position in which it is starting to move back up again.

The invention claimed is:

1. A device for packaging and dispensing several fluid products, comprising at least two extraction pumps with parallel axes, at least two containers containing the products to be dispensed, wherein the first pump is mounted so that it can move axially in the chamber of the second pump, such that the movement of the first pump operates the second pump, and means for expelling the products in the containers sequentially.

2. The device as claimed in claim 1, which further comprises a single push-button acting on a piston of the first pump and means such that the movement of the push-button displaces the body of the first pump and a piston in the chamber of the second pump.

3. The device as claimed in claim 1, wherein each pump comprises a dip tube communicating with independent containers.

4. The device as claimed in claim 3, wherein each container comprises a sealed flexible bag placed in said container and comprising means cooperating with at least one ring for fastening to the rigid container and to the pumps.

5. The device as claimed in claim 4, which comprises at least two bags combined with a single ring for fastening to the container and to the pumps.

6. The device as claimed in claim 4, which comprises two bags made from different materials.

7. The device as claimed in claim 4, which comprises two bags, one inside the other, the neck of the larger bag surrounding that of the smaller one, a space being left between the two necks for filling and expelling the product.

8. The device as claimed in claim 4, which comprises two bags formed as a single piece, in the form of a double bag comprising two compartments separated by a partition.

9. The device as claimed in claim 4, wherein the bags are fastened by snapping their necks onto the ring.

10. The device as claimed in claim 4, wherein the bags are produced by injection-blow molding or extrusion-blow molding a material chosen from among a polyethylene, a polypropylene, a polyamide, and an ethylene/vinyl alcohol (EVOH) copolymer.

11. The device as claimed in claim 4, wherein the bags are produced by welding a plastic or metal film or a multilayer metal/plastic complex on a support forming the neck of the bag.

12. The device as claimed in claim 4, which further comprises an air circuit between the outside and the volume between the wall of the rigid container and the bags.

13. The device as claimed in claim 12, wherein the air circuit consists of a vent in the wall of the rigid container, equipped with a valve and/or a filter.

14. The device as claimed in claim 12, wherein the air circuit consists of a passage made in the ring and the body of the first pump, communicating with the space between the first pump and the push-button, and comprising means for closing it off when the pump is not actuated.

15. The device as claimed in claim 1, which further comprises juxtaposed or concentric product outlet nozzles, to ensure the mixing of the products from each container.

16. The device as claimed in claim 15, wherein the outlet nozzle comprises two concentric annular orifices covered by an elastic film that can deform to allow the fluids coming from the pumps to exit.

17. The device as claimed in claim 15, wherein pump outlet ducts are joined to emerge in a common outlet nozzle wherein the mixing takes place.

18. The device as claimed in claim 1, wherein the containers have different volumes.

19. The device as claimed in claim 1, wherein the volume of a metering chamber of each pump is proportional to the volume of the corresponding container.

* * * * *